US007586449B1

(12) United States Patent
Chen et al.

(10) Patent No.: US 7,586,449 B1
(45) Date of Patent: Sep. 8, 2009

(54) ANTENNA STRUCTURE AND METHOD FOR MANUFACTURING THE ANTENNA STRUCTURE

(75) Inventors: Yung-Jen Chen, Taipei Hsien (TW); Shih-Hao Hu, Taipei Hsien (TW); Kai Shih, Taipei Hsien (TW); Yu-Yuan Wu, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/115,806

(22) Filed: May 6, 2008

(51) Int. Cl.
*H01Q 1/12* (2006.01)

(52) U.S. Cl. ..... 343/702; 343/846

(58) Field of Classification Search ..... 343/702, 343/846, 700 MS, 829
See application file for complete search history.

(56) References Cited

U.S. PATENT DOCUMENTS 5,977,915 A * 11/1999 Bergstedt et al. ..... 343/700 MS
6,049,314 A * 4/2000 Munson et al. ..... 343/846
6,295,031 B1 * 9/2001 Wallace et al. ..... 343/702
7,079,081 B2 * 7/2006 Parsche et al. ..... 343/767
7,310,068 B2 * 12/2007 Hu et al. ..... 343/702
2007/0200774 A1 * 8/2007 Wang et al. ..... 343/702

FOREIGN PATENT DOCUMENTS

TW 091112828 6/2002

* cited by examiner

*Primary Examiner*—Tho G Phan
(74) *Attorney, Agent, or Firm*—WPAT, P.C.; Anthony King

(57) ABSTRACT

An antenna structure includes an antenna pattern having a feeding hollow and a grounding hollow formed in one surface thereof and a feeing cable having an inner lead, a metallic shield, a feeding piece connected to one end of the inner lead and a grounding piece connected to one end of the metallic shield. The feeding piece and the grounding piece of the feeding cable respectively connect to the antenna pattern by conductive glue prearranged in the feeding hollow and the grounding hollow of the antenna pattern. Therefore, the electrical connection between the antenna pattern and the feeding cable is more stable. In addition, the antenna pattern can be formed integrated with a housing of an electric apparatus or plated on the housing, so an extra space can be saved to make the electric apparatus more compact. The present invention also discloses a method for manufacturing the antenna structure.

10 Claims, 5 Drawing Sheets

ANTENNA STRUCTURE AND METHOD FOR MANUFACTURING THE ANTENNA STRUCTURE

BACKGROUND OF THE INVENTION

1. Field of the Invention

The invention relates to the field of antenna, and especially to an improved antenna structure and a method for manufacturing the antenna structure.

2. The Related Art

According to the progress of the communication technology, the key development is the transfer from wired to wireless communication. In the field of wireless communication, an antenna capable of transmitting and receiving wireless signal is the bridge between two wireless apparatuses. The antenna is therefore an essential component in the wireless apparatus.

Many types of antennas for the wireless apparatuses are used, including helix, monopole, inverted-F, dipole, patch, loop and retractable antennas. Helix antenna and retractable antenna are typically installed outside the wireless apparatuses. Inverted-F antenna, monopole antenna, patch antenna, loop antenna and dipole antenna are typically embedded inside the wireless apparatuses.

Generally, embedded antennas are preferred over external antennas for the wireless apparatuses owing to mechanical and ergonomic reasons. Embedded antennas are protected by the case of the wireless apparatuses and therefore tend to be more durable than external antennas.

A conventional embedded antenna is disclosed in Taiwan patent application number 091112828 filed on Jun. 12, 2002. The antenna includes a rectangular base, a planar radiating element disposed on the top of the rectangular base, a plurality of hooks arranged at the bottom of the rectangular base, a feeding contact and a ground contact extending downwardly from the side of the planar radiating element.

Because the hooks of the rectangular base hook predeterminate positions of a printed circuit board, the feeding contact and the ground contact of the planar radiating element connect the corresponding pads of the printed circuit board.

However, the antenna has several shortcomings described hereinafter. To assemble with the antenna, the wireless apparatus must provide an extra space for accommodating the rectangular base of the antenna. This will bulk the wireless apparatus. Moreover, the interconnection between the feeding contact and the ground contact of the planar radiating element and the corresponding pads of the printed circuit board may be unstable once the hooks of the base hook incorrect positions of the printed circuit board.

SUMMARY OF THE INVENTION

An object of the present invention is to provide a method for manufacturing an antenna structure including the following steps:

first step: forming an antenna pattern which has an antenna portion, a ground portion, a feeding section in the antenna portion, a grounding section in the ground portion, a feeding hollow defined in the feeding section, and a ground hollow defined in the grounding section;

second step: providing a feeding cable having an inner lead, a metallic shield, a feeding piece connected to one end of the inner lead, and a grounding piece connected to one end of the metallic shield;

third step: applying a conductive glue in the feeding hollow and the grounding hollow; and fourth step: adhering the feeding piece and the grounding piece of the feeding cable to the feeding section and the grounding section respectively by the conductive glue.

Another object of the present invention is provide an antenna structure including an antenna pattern and a feeing cable. The antenna pattern has an antenna portion, a ground portion, a feeding section in the antenna portion, a grounding section in the ground portion, a feeding hollow defined in the feeding section for accommodating a conductive glue, and a ground hollow defined in the grounding section for accommodating the conductive glue.

The feeding cable has an inner lead, a metallic shield, a feeding piece connected to one end of the inner lead, and a grounding piece connected to one end of the metallic shield. The feeding piece of the feeding cable is connected to the feeding section of the antenna pattern by the conductive glue prearranged in the feeding hollow, and the grounding piece of the feeding cable is connected to the grounding section of the antenna pattern by the conductive glue prearranged in the grounding hollow.

It can be seen that the electrical connection between the antenna pattern and the feeding cable is more stable because the feeding piece and the grounding piece of the feeding cable are adhered to the feeding section and the grounding section of the antenna pattern. In addition, the antenna structure can be formed integrated with a housing of an electric apparatus or plated on the housing, so an extra space as mentioned in the prior art can be saved. Therefore, the electric apparatus can be more compact.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENT

Figure 1:
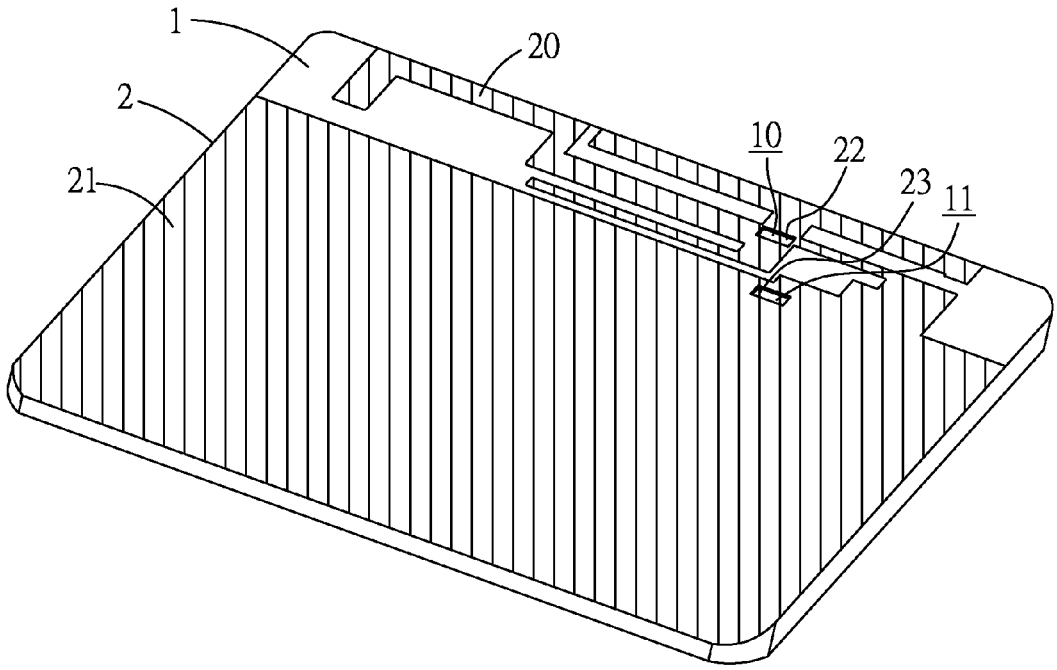
FIG. 1 shows a first preferred embodiment of an antenna structure having an insulation plate and an antenna pattern according to the present invention.
Figure 2:
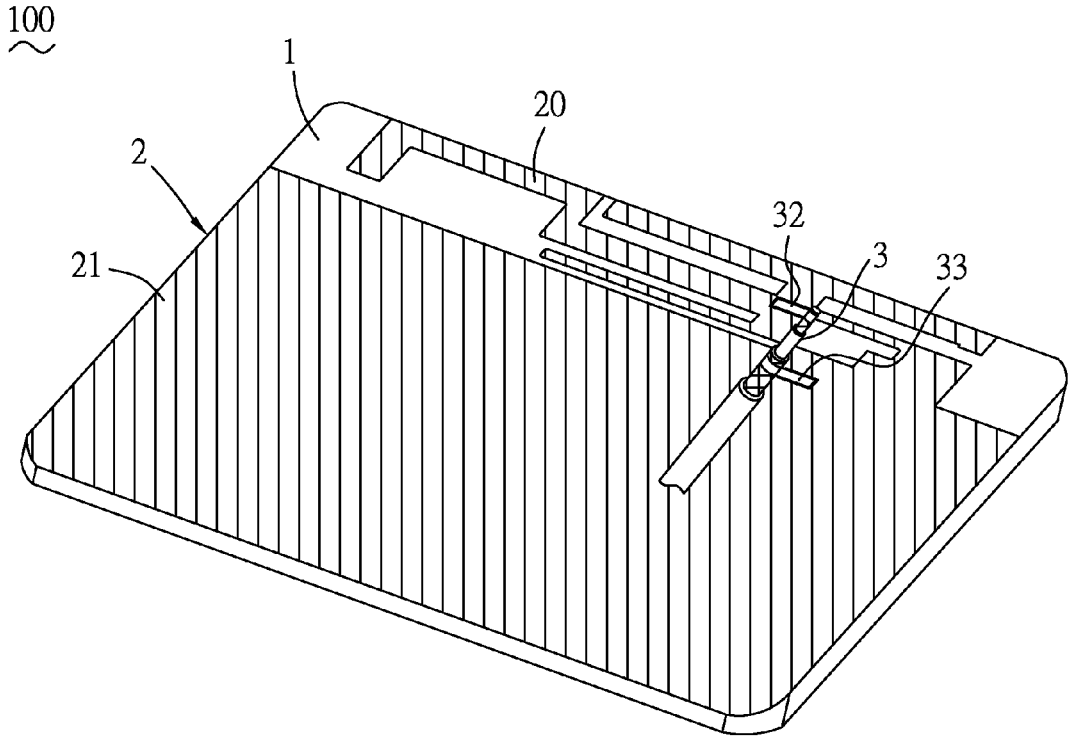
FIG. 2 is a perspective view showing the antenna structure of FIG. 1 connecting to a feeding cable.
Figure 3:
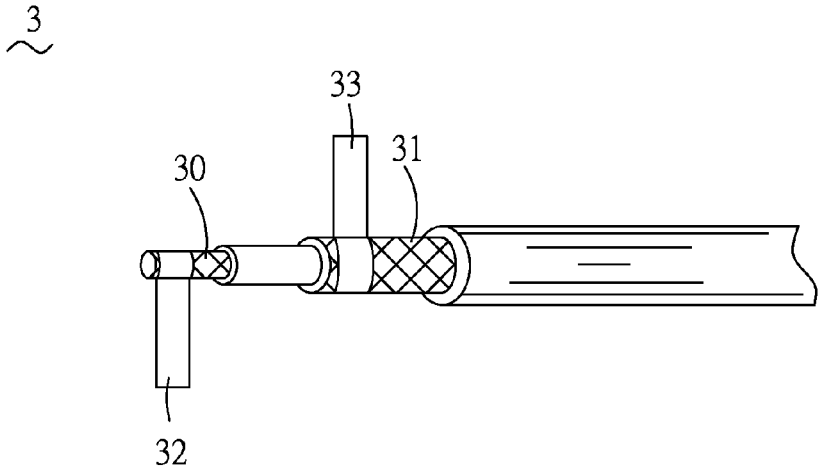
FIG. 3 is a perspective view of the feeding cable shown in FIG. 2.

Please refer to FIG. 1 to FIG. 3. A first preferred embodiment of an antenna structure 100 is shown. The antenna structure 100 has an insulation plate 1, an antenna pattern 2 and a feeding cable 3.

The antenna pattern 2 is disposed on the surface of the insulation plate 1 and has an antenna portion 20, a ground portion 21, a feeding section 22 consisted in the antenna portion 20, and a grounding section 23 consisted in the ground portion 21. The feeding section 22 defines a feeding hollow 10 therein. The grounding section 23 defines a grounding hollow 11 therein.

The feeding cable 3 has an inner lead 30, a metallic shield 31 wrapping the inner lead 30 and insulated from the inner lead 30, a feeding piece 32 soldered to one end of the inner lead 30, and a grounding piece 33 soldered to one end of the metallic shield 31.

The feeding piece 32 and the grounding piece 33 of the feeding cable 3 are respectively adhered to the feeding section 22 and the grounding section 23 of the antenna pattern 2 by conductive glue that is prearranged in the feeding hollow 10 and the grounding hollow 11.

A first method for manufacturing the antenna structure 100 is described as following:

first step: forming the insulation plate 1 by injection molding;

second step: forming the antenna pattern 2 on the surface of the insulation plate 1, the antenna pattern 2 having the antenna portion 20, the ground portion 21, the feeding section 22 consisted in the antenna portion 20, and the grounding section 23 consisted in the ground portion 21, wherein the feeding section 22 and the grounding section 23 define the feeding hollow 10 and the grounding hollow 11 respectively;

third step: providing the feeding cable 3 which has the inner lead 30, the metallic shield 31, the feeding piece 32, and the grounding piece 31, wherein the feeding piece 32 and the grounding piece 33 soldered to one end of the inner lead 30 and one end of the shield 31 respectively;

fourth step: applying conductive glue in the feeding hollow 10 and the grounding hollow 11; and fifth step: adhering the feeding piece 32 of the feeding cable 3 to the feeding section 22 of the antenna pattern 2 by the conductive glue for establishing the electrical connection therebetween, and adhering the grounding piece 33 of the feeding cable 3 to the grounding section 23 of the antenna pattern 2 by the conductive glue for establishing the electrical connection therebetween.

In this case, the insulation plate 1 is made of insulation material such as ABS (Acrylonitrile Butadiene Styrene) or PC (Polycarbonate). The antenna pattern 2 is formed on the surface of the insulation 1 by any suitable methods such as electroplating, spraying and etc. The feeding piece 32 and the grounding piece 33 of the cable 3 is made of metallic material such as copper or nickel.

Figure 4:
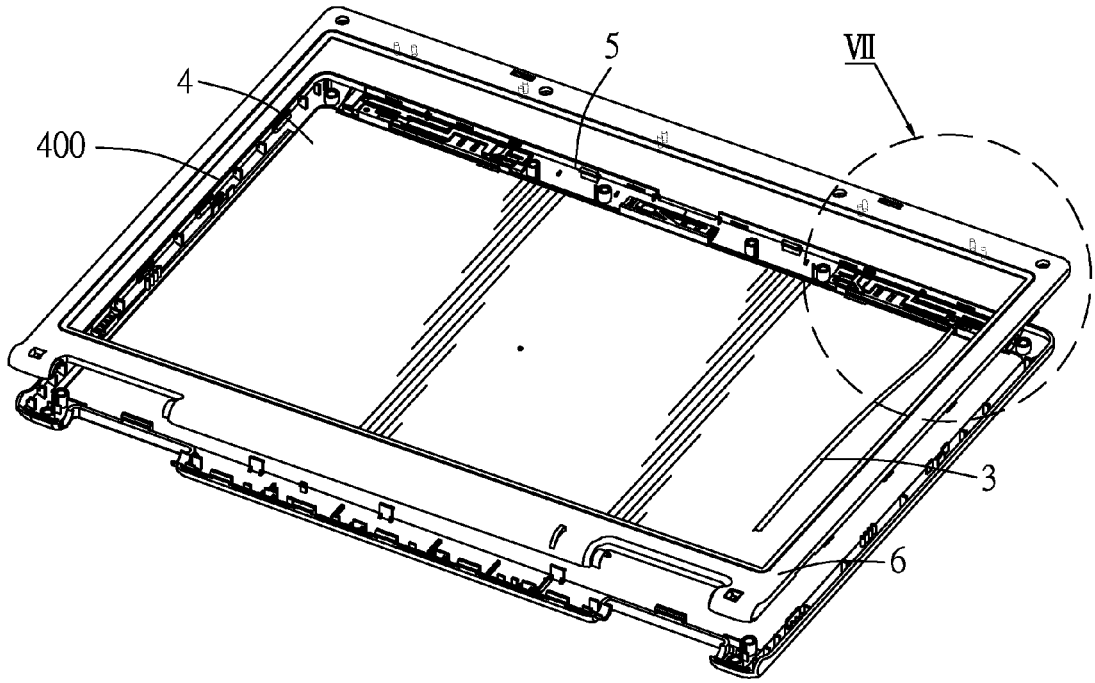
FIG. 4 is an exploded view showing the antenna structure to be assembled with a housing of an electric apparatus.
Figure 5:
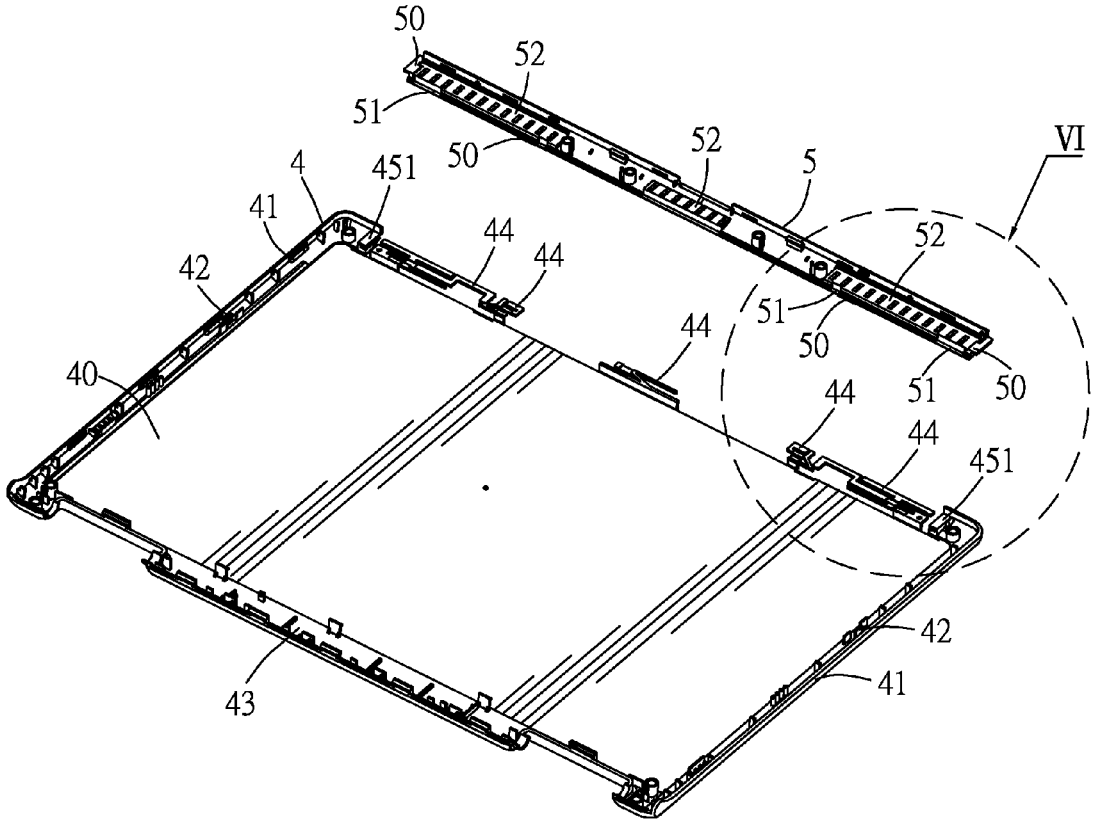
FIG. 5 is an exploded view showing a second preferred embodiment of an antenna structure according to the present invention.

Referring to FIG. 4 and FIG. 5, which shows a second preferred embodiment of the antenna structure 400. The antenna structure 400 is integratedly formed with a metallic cover. In this case, the antenna structure 400 is integratedly formed with a metallic case 4 consisted in a display housing of a laptop. In this case, the display housing of the laptop includes the metallic case 4 and a front case 6 engaging with the metallic case 4. The antenna structure 400 includes the metallic case 4, the feeding cable 3 as described above, and an insulation base 5.

Figure 6:
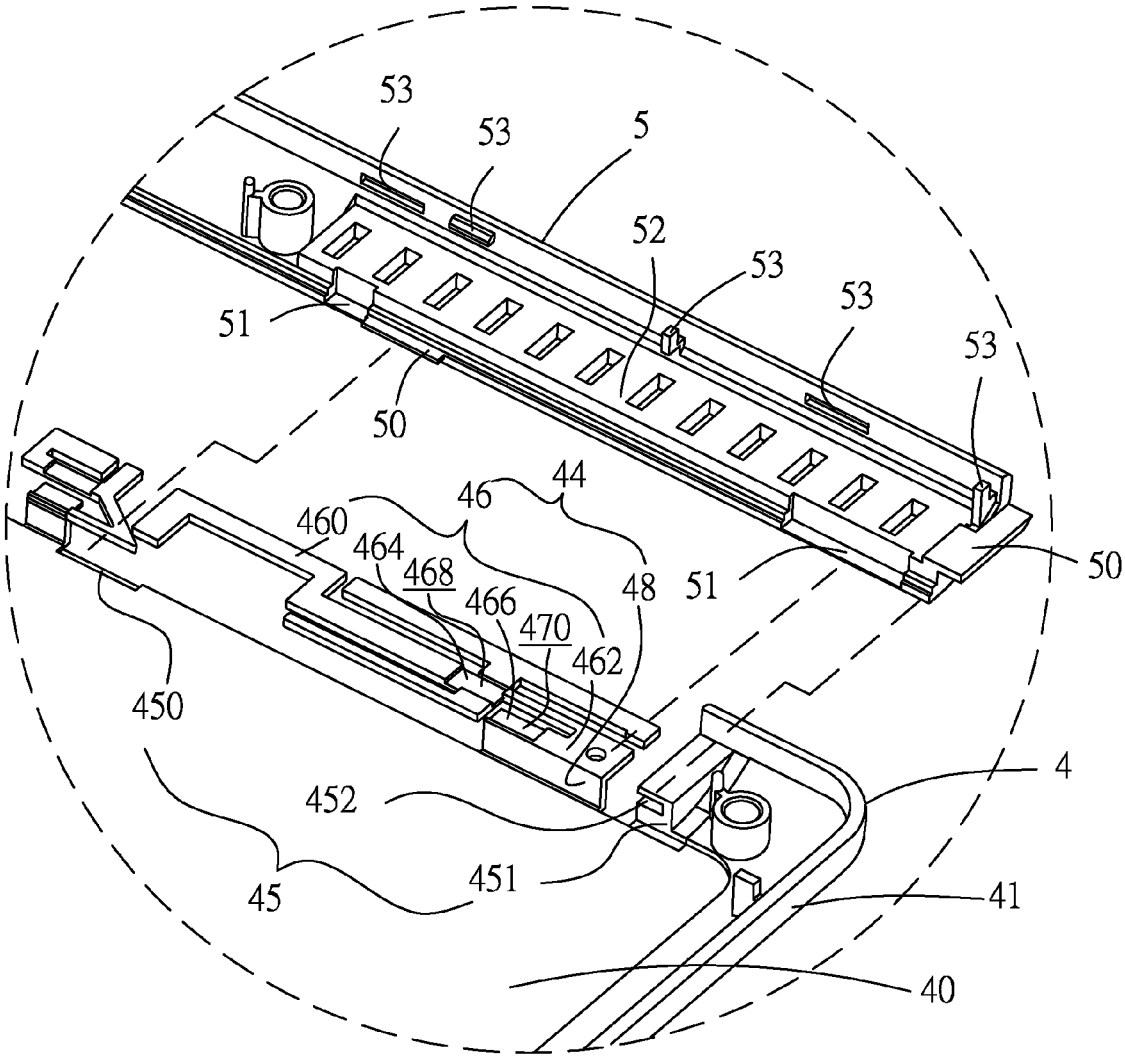
FIG. 6 is a partially enlarged view of an encircled portion VI of FIG. 5.

Please refer to FIG. 5 and FIG. 6. The metallic case 4 includes a metallic plate 40 defining opposite lateral sides, a top side and a bottom side, two side walls 41 extending outwardly and upwardly from the lateral sides of the metallic plate 40, a plurality of locking elements 42 extending upwardly from the side wall 41 for engaging with the front case 6, a coupling portion 43 extending outwardly and upwardly from the bottom side of the metallic plate 40 for coupling with hinges (not shown in figures), at least one antenna body 44 extending outwardly and upwardly from the top side of the metallic plate 40, and an engaging portion 45 formed at the top side of the metallic plate 40.

The antenna body 44 includes an antenna pattern 46 in a plane parallel to the metallic plate 40 and a connecting arm 48 extending upwardly from the top side of the metallic plate 40 to connect the antenna pattern 46 with the metallic plate 40 and lift the antenna pattern 46. The antenna pattern 46 has an antenna portion 460, a ground portion 462, a feeding section 464 consisted in the antenna portion 460, and a grounding section 466 consisted in the ground portion 462. The feeding section 464 defines a feeding hollow 468 therein. The grounding section 466 defines a grounding hollow 470 therein.

The engaging portion 45 includes a plurality of cavities 450 formed in the top side of the metallic plate 40, at least two blocks 451 extending outwardly and upwardly form the top side of the metallic plate 40 and a groove 452 formed in the blocks 451. In this case, the antenna body 44 is formed between the blocks 451.

The insulation base 5 is arranged on the top side of the metallic plate 40 and engaged with the engaging portion 45. In this case, the antenna pattern 46 of the antenna body 44 is arranged on the insulation base 5. The insulation base 5 includes a plurality of engaging arms 50 extending from the periphery thereof for engaging with the cavities 450 and the groove 452 of the engaging portion 45, at least one concave portion 51 formed at one side thereof for receiving the connecting arm 440 of the antenna body 44, at least one supporting plane 52 formed on one surface thereof for holding the antenna pattern 46 of the antenna body 44, and a plurality of locking elements 53 extending upwardly thereof for engaging with the front case 6.

Figure 7:
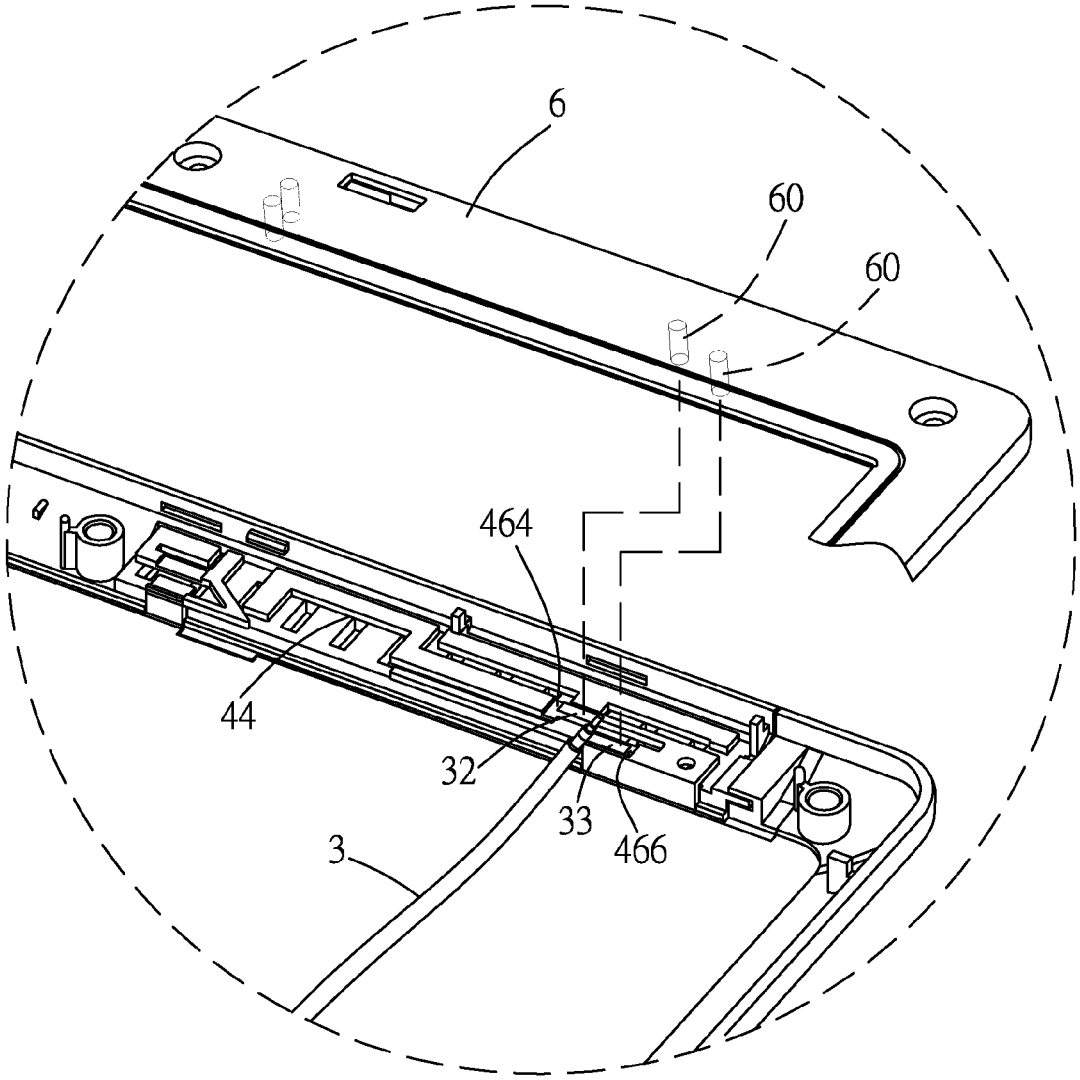
FIG. 7 is a partially enlarged view of an encircled portion VII of FIG. 4.

Please refer to FIG. 7. The feeding piece 32 and the grounding piece 33 of the feeding cable 3 are respectively adhered in the feeding hollow 468 and the grounding hollow 470 of the antenna body 44 by the conductive glue. Therefore, the feeding piece 32 and the grounding piece 33 of the feeding cable 3 are adhered and connected to the feeding section 464 and the grounding section 466 of the antenna body 44 respectively.

Furthermore, the front case 6 includes a plurality of posts 60 corresponding to the feeding hollow 468 and the grounding hollow 470 of the antenna body 44. The posts 60 are pressed on the feeding piece 32 and the grounding piece 33 of the feeding cable 3 respectively while the metallic case 4 and the front case 6 are assembled. Therefore, the feeding piece 32 and the grounding piece 33 of the cable 3 are stably received in the feeding hollow 468 and the grounding hollow 470 of the antenna body 44 respectively through the pressing force of the post 60.

A second method for manufacturing the antenna structure 400 is described as following:

first step: forming the metallic case 4 integrated with the antenna pattern 46 by casting, and the antenna pattern 46 having the antenna portion 460, the ground portion 462, the feeding section 464 consisted in the antenna portion 460, the grounding section 466 consisted in the ground portion 462, the feeding hollow 468 defined in the feeding section 464, and the grounding hollow 470 defined in the grounding section 466 second step: providing the feeding cable 3 which has the inner lead 30, the metallic shield 31 wrapping the inner lead 30, the feeding piece 32 soldered to one end of the inner lead 30, and the grounding piece 33 soldered to one end of the shield 31;

third step: applying conductive glue in the feeding hollow 468 and the grounding hollow 470 of the antenna body 44; and fourth step: adhering the feeding piece 32 of the feeding cable 3 to the feeding section 464 by the conductive glue for establishing the electrical connection therebetween, and adhering the grounding piece 33 of the feeding cable 3 to the grounding section 466 by the conductive glue for establishing the electrical connection therebetween.

In accordance with the aspect of the present invention, the antenna pattern of the antenna structure 100, 400 may be plated on the insulation plate or may be integrated with metallic case, especially plated on the insulated housing or formed integrated with the metallic housing of the electric apparatus.

Therefore, an extra space in the electric apparatus is saved. Furthermore, the electrical connection between the antenna pattern 2, 46 and the feeding cable 3 is more stable because the feeding piece 32 and the grounding piece 33 of the feeding cable 3 are adhered to the feeding section 464 and the grounding section 466. Moreover, the antenna characteristic of the antenna body 44, such as antenna efficiency and VSWR (Voltage Standing Wave Ratio), is improved because the metallic case 4 can be the ground of the antenna body 44.

Furthermore, the antenna pattern 2, 44 can be operated in single band or multi-bands. The antenna pattern 2, 44 further can be a wireless wide area network antenna operating in telecommunication frequency bands such as GSM 850 MHz, EGSM 900 MHz, DCS 1800 MHz, PCS 1900 MHz, UMTS 2100 MHz and etc, or a location area network antenna operating in data transmission bands such as 2.4 GHz, 5.2 GHz and etc.

The present invention is not limited to the embodiments described above; various additions, alterations and the like may be made within the scope of the present invention by a person skilled in the art. For example, respective embodiments may be appropriately combined.

What is claimed is:

1. A method for manufacturing an antenna structure, comprising:

forming an antenna pattern which has an antenna portion, a ground portion, a feeding section in the antenna portion, a grounding section in the ground portion, a feeding hollow defined in the feeding section, and a ground hollow defined in the grounding section;

providing a feeding cable having an inner lead, a metallic shield wrapping said inner lead, a feeding piece connected to one end of said inner lead, and a grounding piece connected to one end of said metallic shield;

applying a conductive glue in said feeding hollow and said grounding hollow; and adhering said feeding piece and said grounding piece of said feeding cable to said feeding section and said grounding section respectively by said conductive glue.

2. The method for manufacturing an antenna structure as claimed in claim 1, wherein said antenna pattern is plated on an insulation plate.

3. The method for manufacturing an antenna structure as claimed in claim 1, wherein said antenna pattern is formed integrated with a metallic case.

4. An antenna structure for an electric apparatus, comprising:

an antenna pattern having an antenna portion, a ground portion, a feeding section in the antenna portion, a grounding section in the ground portion, a feeding hollow defined in the feeding section for accommodating a conductive glue, and a grounding hollow defined in the grounding section for accommodating said conductive glue; and a feeding cable having an inner lead, a metallic shield wrapping said inner lead, a feeding piece connected to one end of said inner lead, and a grounding piece connected to one end of said metallic shield, wherein said feeding piece of said feeding cable is connected to said feeding section of said antenna pattern by said conductive glue prearranged in said feeding hollow, and said grounding piece of said feeding cable is connected to said grounding section of said antenna pattern by said conductive glue prearranged in said grounding hollow.

5. The antenna structure as claimed in claim 4, wherein said electric apparatus has a metallic case, and said antenna pattern is formed integrated with said metallic case.

6. The antenna structure as claimed in claim 5, wherein the electric apparatus further has a front case engaged with said metallic case, said front case has at least two posts for pressing on said feeding piece and said grounding piece of said feeding cable.

7. The antenna structure as claimed in claim 5, wherein said metallic case has a metallic plate, said antenna pattern is in a plane parallel to said metallic plate, a connecting arm extends upwardly from one side of said metallic plate to connect the antenna pattern with the metallic plate and lift the antenna pattern.

8. The antenna structure as claimed in claim 7, wherein said electric apparatus further has an insulation base supporting said antenna pattern.

9. The antenna structure as claimed in claim 8, wherein said insulation base has a concave portion formed at one side thereof for receiving said connecting arm and a supporting plane formed on one surface thereof for holding said antenna pattern.

10. The antenna structure as claimed in claim 9, wherein said insulation base engages with said metallic case by an engaging portion, said engaging portion has at least one cavity formed at the same side of said metallic plate as which said connecting arm extends from, at least two blocks extending upwardly and outwardly from the same side of said metallic plate as which said connecting arm extends from, a groove formed in said block, a plurality of engaging arms extending from the peripheral of said insulation base for engaging with said cavity and said groove.

* * * * *